US009864325B2

(12) United States Patent
Yamamoto

(10) Patent No.: US 9,864,325 B2
(45) Date of Patent: Jan. 9, 2018

(54) IMAGE FORMING APPARATUS HAVING COVER OPENABLE AND CLOSABLE AT SIDE SURFACE OF APPARATUS

(71) Applicant: BROTHER KOGYO KABUSHIKI KAISHA, Nagoya-shi, Aichi-ken (JP)

(72) Inventor: Koyo Yamamoto, Nisshin (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/441,521

(22) Filed: Feb. 24, 2017

(65) Prior Publication Data

US 2017/0248902 A1 Aug. 31, 2017

(30) Foreign Application Priority Data

Feb. 29, 2016 (JP) ..... 2016-037992

(51) Int. Cl.
*G03G 15/00* (2006.01)
*G03G 21/16* (2006.01)

(52) U.S. Cl.
CPC ..... *G03G 21/1633* (2013.01)

(58) Field of Classification Search
CPC ..... G03G 21/1633
USPC ..... 399/110
See application file for complete search history.

(56) References Cited

U.S. PATENT DOCUMENTS

2007/0065174 A1* 3/2007 Rennick ..... G03G 21/1638 399/110
2009/0317125 A1* 12/2009 Tomatsu ..... G03G 21/1853 399/110
2012/0099896 A1* 4/2012 Kamano ..... G03G 15/161 399/121

FOREIGN PATENT DOCUMENTS

JP 6-130742 A 5/1994
JP 9-246745 A 9/1997
JP 2002-111243 A 4/2002
JP 2007-168405 A 7/2007

* cited by examiner

*Primary Examiner* — Susan Lee
(74) *Attorney, Agent, or Firm* — Merchant & Gould P.C.

(57) ABSTRACT

In an image forming apparatus, a cover has a pivot shaft and is pivotally movable between a closed position and an open position. The link member is slidingly movable in a direction parallel to the pivot shaft in response to depression of a button. The locking member provides locking engagement between the cover and a housing, and is pressed by the link member in accordance with the sliding movement of the link member to release the locking engagement. The push member is movable in a direction opposite to an opening direction of the cover to be pressed against the housing when the cover is at the closed position in accordance with the sliding movement of the link member. The depression of the button causes both unlocking and movement of the cover in the opening direction when the cover is at the closed position.

8 Claims, 11 Drawing Sheets

IMAGE FORMING APPARATUS HAVING COVER OPENABLE AND CLOSABLE AT SIDE SURFACE OF APPARATUS

CROSS REFERENCE TO RELATED APPLICATION

This application claims priority from Japanese Patent Application No. 2016-037992 filed on Feb. 29, 2016. The entire content of the priority application is incorporated herein by reference.

TECHNICAL FIELD

The present disclosure relates to an image forming apparatus having a cover openable and closable at a side surface of the apparatus.

BACKGROUND

A conventional image forming apparatus such as a laser printer includes a cover opened and closed relative to a housing of the apparatus for processing sheet jamming or for replacing a process unit with a new process unit. A locking mechanism is provided for avoiding unintentional opening of the cover when the cover is at the closed state. Upon releasing the locking mechanism, the cover is opened by a biasing force of a spring.

However, the cover is not opened when a user touches the cover or the locking mechanism may contain inherent defects in the structure utilizing the biasing force of the spring.

SUMMARY

It is an object of the disclosure to provide an image forming apparatus having a compact size in vertical direction and capable of opening the cover with a small force.

In order to attain the above and other objects, the present disclosure provides an image forming apparatus that includes: a housing; a cover; a button; a link member; a first locking member; and a push member. The housing has a side surface. The side surface has a first opening. The cover has a first pivot shaft positioned adjacent to a lower end of the first opening. The cover is pivotally movable about an axis of the first pivot shaft between a closed position closing the first opening and an open position opening the first opening. The button is provided at the cover and is configured to be depressed. The link member is provided at the cover and is configured to be slidingly moved in a prescribed direction parallel to the first pivot shaft in response to the depression of the button. The first locking member is provided at the cover and is configured to provide locking engagement between the cover and the housing. The first locking member is pressed by the link member in accordance with the sliding movement of the link member in the prescribed direction to release the locking engagement. The push member is provided at the cover and is configured to move in a direction opposite to an opening direction of the cover to be pressed against the housing when the cover is at the closed position in accordance with the sliding movement of the link member in the prescribed direction. The depression of the button causes both unlocking and movement of the cover in the opening direction when the cover is at the closed position.

BRIEF DESCRIPTION OF THE DRAWINGS

The particular features and advantages of the disclosure will become apparent from the following description taken in connection with the accompanying drawings, in which.

DETAILED DESCRIPTION

An image forming apparatus according to one embodiment will be described with reference to the accompanying drawings.

[External Configuration of Image Forming Apparatus]

Figure 1:
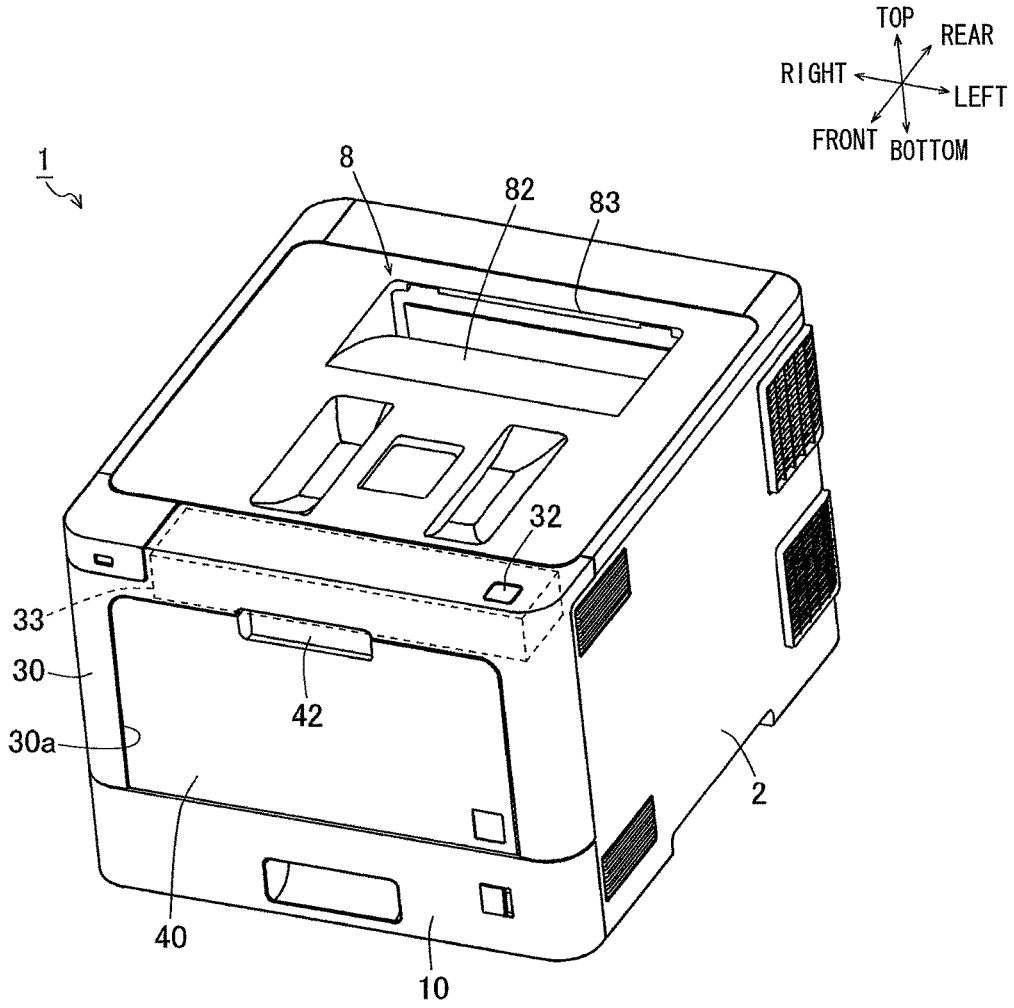
FIG. 1 is a perspective view of an image forming apparatus and illustrating a closed state of a cover according to one embodiment.
Figure 2:
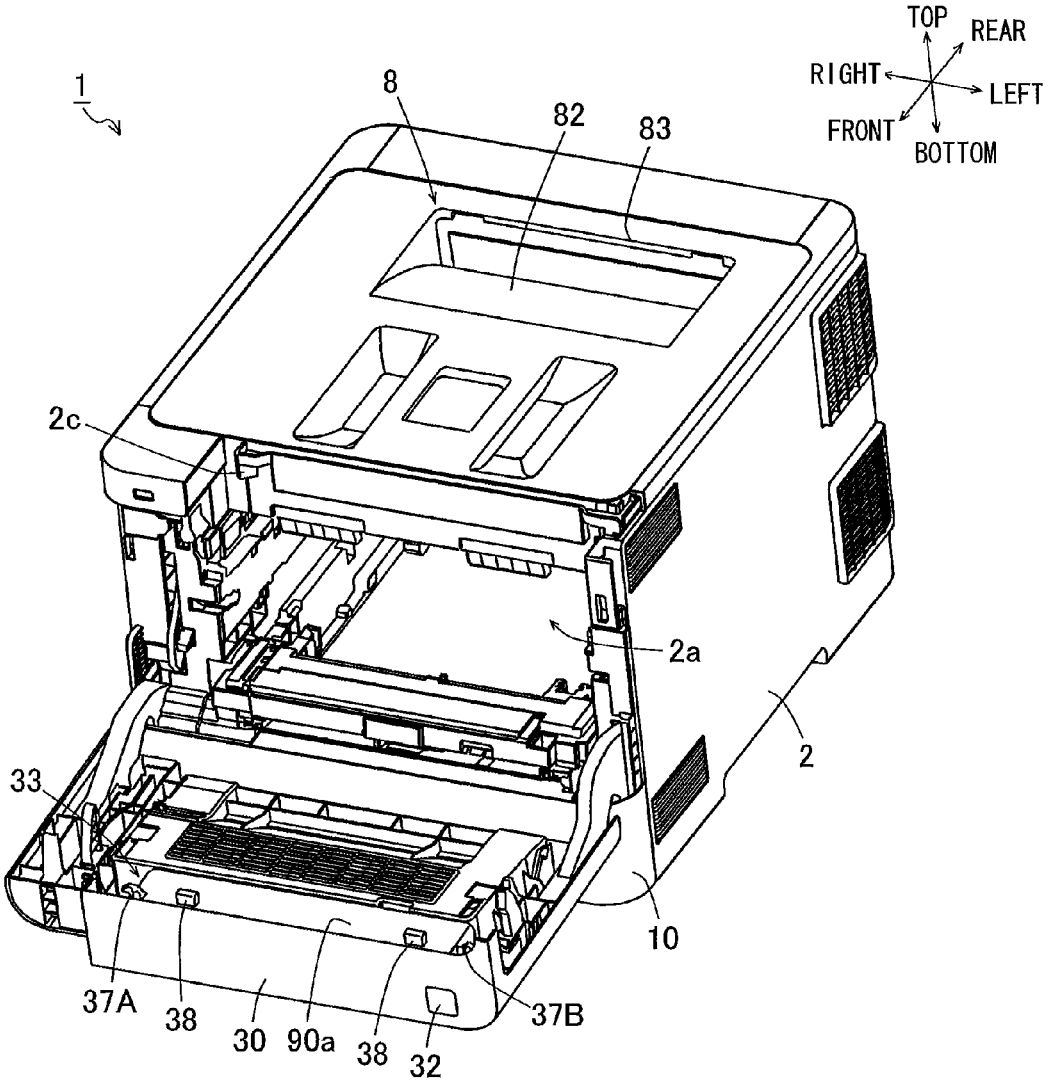
FIG. 2 is a perspective view of the image forming apparatus and illustrating an open state of the cover according to the embodiment.

FIGS. 1 and 2 illustrate external configuration of the image forming apparatus. In the following description, the terms "upward", "downward", "upper", "lower", "above", "below", "beneath", "right", "left", "front", "rear" and the like will be used assuming that the image forming apparatus is disposed in an orientation in which it is intended to be used as illustrated in FIGS. 1 and 2.

The image forming apparatus 1 includes a housing 2 generally box shaped. The housing 2 has an upper surface at which a discharge tray 82 is provided for receiving a sheet discharged from an inside of the housing 2. The discharge tray 82 has a sloped surface sloping downward in rearward direction. A discharge opening 83 is formed at a position rearward of the sloping surface, so that the sheet is discharged on to the discharge tray 82 through the discharge opening 83.

The housing 2 has a front wall at which a first opening 2*a* is formed for processing sheet jamming or for replacing an image forming unit 5 (FIG. 3) with a new unit. A front cover 30 is provided at the front wall. The front cover 30 is provided with a front cover pivot shaft 31 (FIG. 3) including a first pivot shaft extending parallel to a bottom wall of the housing 2 and along the first opening 2*a* at a position adjacent to a lower end of the housing 2. The front cover 30 is pivotally movable about an axis of the front cover pivot shaft 31 between a closed position (FIG. 1) closing the first opening 2*a* and an open position (FIG. 2) opening the first opening 2*a*.

A button 32 is provided for opening the front cover 30 at a position adjacent to a left end portion of an upper surface of the front cover 30 in its closed position. The button 32 is easily visible and easily pressed down since the button 32 is positioned at the upper surface of the front cover 30. By pressing down the front cover 30 in a closed state of the front cover 30 as illustrated in FIG. 1, a front cover opening/closing mechanism 33 accommodated in the upper portion of the front cover 30 for opening and closing the front cover 30 is unlocked to slightly move the front cover 30 in an opening direction. Then, the front cover 30 is pivotally moved frontward by a user to move the front cover 30 to its open position as illustrated in FIG. 2.

A second opening 30*a* (see FIG. 3) is formed at a front wall of the front cover 30 for manually inserting a sheet. A multi-purpose tray (hereinafter simply referred to as MP tray) 40 which is openable and closable is attached to the second opening 30*a* for permitting the sheet to be mounted on the MP tray 40. A pivot shaft 41 is provided at a position adjacent to a lower end of the second opening 30*a*. The pivot shaft 41 includes a second pivot shaft extending parallel to the front cover pivot shaft 31, so that the MP tray 40 is pivotally movable about an axis of the pivot shaft 41 between a closed position closing the second opening 30*a* and an open position opening the second opening 30*a*.

As illustrated in FIG. 1, a hand grip 42 is provided at a free end portion of the MP tray 40 for opening the MP tray 40. The MP tray 40 can be opened by user's pulling the hand grip 42 frontward when the front cover 30 is at the closed position. A multi-purpose tray lock mechanism (MP tray lock mechanism) 43 (see FIG. 9) is engageable with the front cover 30 for preventing the MP tray 40 from being opened when the front cover 30 is at the open position.

[Internal Structure of Image Forming Apparatus]

The image forming apparatus 1 includes a sheet supply unit 3, a motor 4, an image forming unit 5, and a sheet discharge unit 8. The sheet supply unit 3 is positioned at a lower portion and a front portion in the housing 2 and is adapted to supply a sheet S accommodated in the sheet supply unit 3 to the image forming unit 5. The image forming unit 5 is positioned downstream of the sheet supply unit 3 in a sheet conveying direction, and is adapted to form an image on the sheet supplied from the sheet supply unit 3. The sheet discharge unit 8 is positioned downstream of the image forming unit 5 in the sheet conveying direction, and is adapted to discharge the sheet S on which the image has been formed to an outside of the housing 2.

The sheet supply unit 3 includes a sheet tray 10, a sheet supply mechanism 20, a conveyer roller 24, and a registration roller 26 those being positioned at the lower portion of the housing 2, and the MP tray 40, a multi-purpose side separation roller (MP side separation roller) 28, and a multi-purpose side separation pad (MP side separation pad) 29 those being positioned at the front portion of the housing 2.

A sheet tray accommodating portion 2*b* is provided in the housing 2 at a lower portion thereof, and the sheet tray 10 is attachable to and detachable from the sheet tray accommodating portion 2*b*. The sheet tray 10 can be positioned at the sheet tray accommodating portion 2*b* to obtain attached position by inserting the sheet tray 10 leftward from a right side of the housing 2. The sheet tray 10 can be positioned at a separated position separated from the sheet tray accommodating portion 2*b* by pulling the sheet tray 10 rightward.

The sheet tray 10 includes a tray body 11, a lifter plate 12 and an elevation member 13. A plurality of sheets S is received in the tray body 11. The plurality of sheets S in the tray body 11 is mounted on the lifter plate 12, and the lifter plate 12 displaces the sheets S in vertical direction. The elevation member 13 is adapted to elevate the lifter plate 12.

Figure 3:
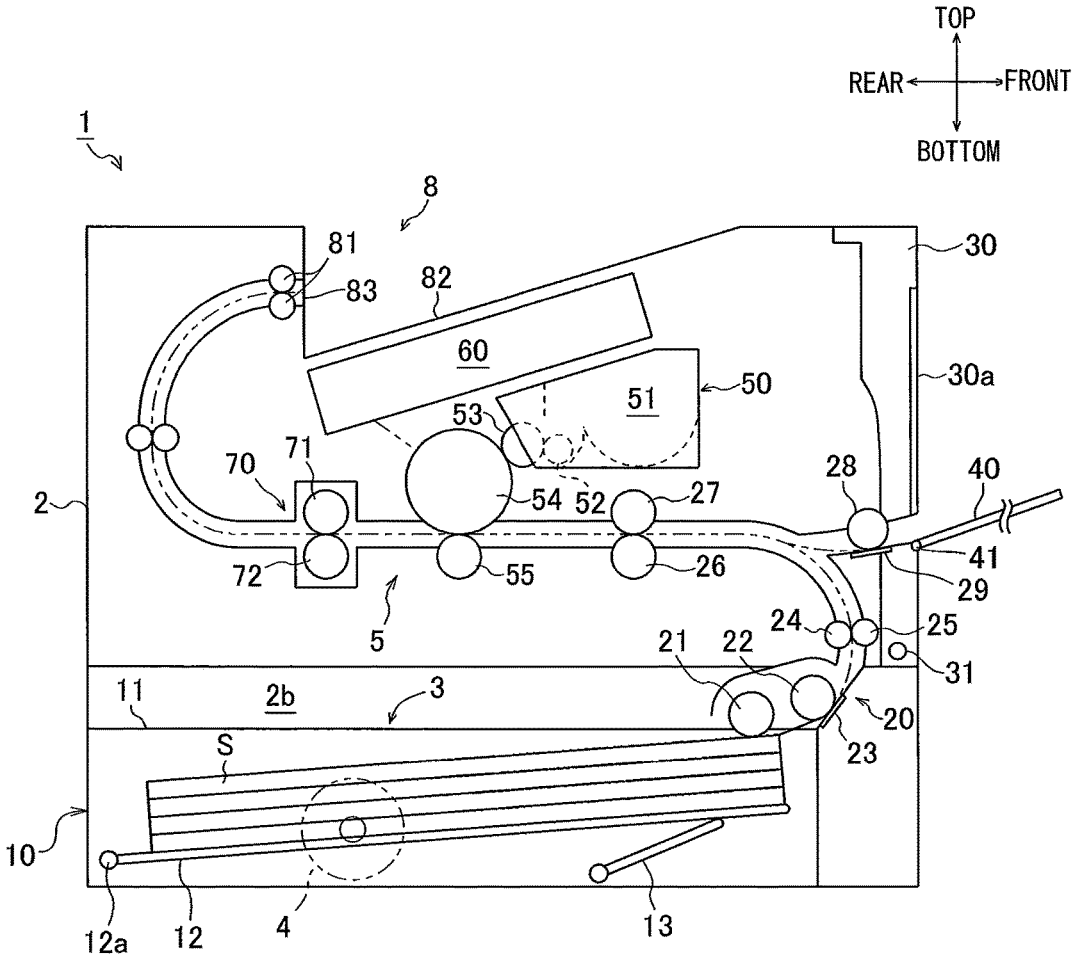
FIG. 3 is a schematic central cross-sectional view of the image forming apparatus according to the embodiment.
Figure 4:
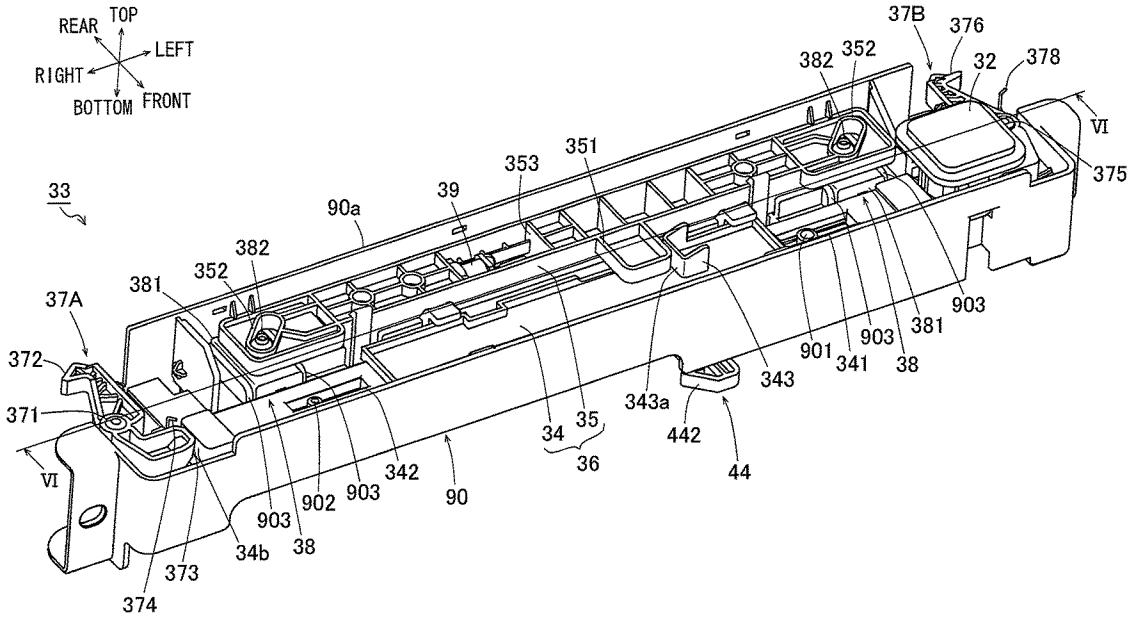
FIG. 4 is a perspective view of an opening/closing mechanism for a front cover as viewed from a top side of the mechanism in the image forming apparatus according to the embodiment.

The lifter plate 12 has one end portion pivotally movably supported by a pivot shaft 12*a*, so that the lifter plate 12 is displaceable in vertical direction. The elevation member 13 is driven by the motor 4, so that its free end portion can be elevated. In accordance with the elevation of the free end portion of the elevation member 13, the lifter plate 12 is elevated, so that the sheets mounted on the lifter plate 12 can be lifted upward to a sheet supplying position as illustrated in FIG. 3.

The sheet supply mechanism 20 is adapted to pick-up each one of the sheets mounted on the sheet tray 10, and to convey the sheet to the conveyer roller 24. The sheet supply mechanism 20 includes a pick-up roller 21, a separation roller 22, and a separation pad 23.

The pick-up roller 21 is positioned above the lifter plate 12 and is adapted to pick up the sheet S elevated by the lifter plate 12 to the sheet supplying position. The separation roller 22 is positioned downstream of the pick-up roller 21 in the sheet conveying direction. The separation pad 23 is in confrontation with the separation roller 22, and is urged toward the separation roller 22. The sheet S picked up by the pick-up roller 21 is conveyed to the separation roller 22, and a single sheet S is moved past between the separation roller 22 and the separation pad 23 and is conveyed to the conveyer roller 24.

The conveyer roller 24 is adapted to apply conveying force to the sheet S. The conveyer roller 24 is positioned downstream of the sheet supply mechanism 20 in the sheet conveying direction. An opponent roller 25 is in confrontation with the conveyer roller 24. The sheet S conveyed from the sheet supply mechanism 20 toward the conveyer roller 24 is nipped between the conveyer roller 24 and the opponent roller 25 and is conveyed toward the registration roller 26.

The registration roller 26 is positioned downstream of the conveyer roller 24 in the sheet conveying direction. An opposing roller 27 is positioned in confrontation with the registration roller 26 so as to regulate a movement of a leading end of the sheet S, and to temporarily stop the sheet S, and then convey the sheet to an image transfer position at a prescribed timing.

The MP tray 40 is adapted to mount thereon a plurality of sheets S. The MP side separation roller 28 is adapted to pick up each one of the sheets and then convey the sheet toward the registration roller 26. The MP side separation pad 29 is positioned in confrontation with the MP side separation roller 28, and is urged toward the MP side separation roller 28. A single sheet S is moved past between the MP side separation roller 28 and the MP side separation pad 29, and is then conveyed toward the registration roller 26.

The image forming unit 5 includes a process cartridge 50, an exposure unit 60, and a fixing unit 70. The process cartridge 50 is adapted to form an image on a surface of the sheet S conveyed from the sheet supply unit 3. The process cartridge 50 includes a photosensitive drum 54, and the exposure unit 60 is adapted to expose light to a surface of the photosensitive drum 54. The fixing unit 70 is adapted to fix the transferred image to the sheet S.

The process cartridge 50 is positioned above the sheet tray accommodating portion 2*b* in the housing 2, and includes a developing agent accommodation chamber 51, a supply roller 52, a developing roller 53, the photosensitive drum 54, and a transfer roller 55.

The developing agent accommodation chamber 51 is adapted to accommodate therein toner as developing agent. The toner in the developing agent accommodation chamber 51 is agitated by an agitation member (not shown) and is supplied to the supply roller 52. The supply roller 52 is adapted to supply toner from the developing agent accommodation chamber 51 to the developing roller 53.

The developing roller 53 and the supply roller 52 are in intimate contact with each other. The developing roller 53 is adapted to carry toner supplied from the supply roller 52 and charged with positive polarity by a friction member (not shown). Further, developing bias with positive polarity is applied to the developing roller 53 by a bias application unit (not shown).

The photosensitive drum 54 is positioned adjacent to the developing roller 53. After the surface of the photosensitive drum 54 is uniformly charged with positive polarity by a charger (not shown), the surface is exposed to light by the exposure unit 60. The exposed region of the photosensitive drum 54 provides a potential lower than that of the non-exposed region, so that an electrostatic latent image based on image data is formed on the surface of the photosensitive drum 54. Then, a visible toner image corresponding to the electrostatic latent image is formed on the surface of the photosensitive drum 54 by supplying toner having positive polarity from the developing roller 53.

The transfer roller 55 is in confrontation with the photosensitive drum 54, and is applied with transfer bias of negative polarity by a bias application unit (not shown). The toner image carried on the surface of the photosensitive drum 54 is transferred onto the sheet S when the sheet S is moved past a transferred position between the photosensitive drum 54 and the transfer roller 55 while the transfer bias is applied to the surface of the transfer roller 55.

The exposure unit 60 includes a laser diode, a polygon mirror, lenses and reflection mirrors those not shown. The exposure unit 60 is adapted to irradiate laser light on a basis of image data input into the image forming apparatus 1 to expose the surface of the photosensitive drum 54 to light.

The fixing unit 70 includes a heat roller 71 and a pressure roller 72. The heat roller 71 is rotationally driven by the motor 4, and is heated by an electrical power supplied from a power source (not shown). The pressure roller 72 is in confrontation with the heat roller 71 and is in contact with the heat roller 71 so as to be rotated by the rotation of the heat roller 71. When the sheet S on which the toner image has been transferred is conveyed to the fixing unit 70, the sheet S is conveyed while being nipped between the heat roller 71 and the pressure roller 72, thereby thermally fixing the image to the sheet S.

The sheet discharge unit 8 includes a discharge roller 81 and the discharge tray 82. The discharge roller 81 is constituted by a pair of rollers for directing the sheet conveyed from the fixing unit 70 toward outside of the housing 2. The discharge tray 82 is formed at the upper surface of the housing 2, so that the sheet S discharged outside the housing 2 through the discharge opening 83 is stacked on the discharge tray 82.

[Structure of Mechanism for Opening and Closing Front Cover]

Figure 5:
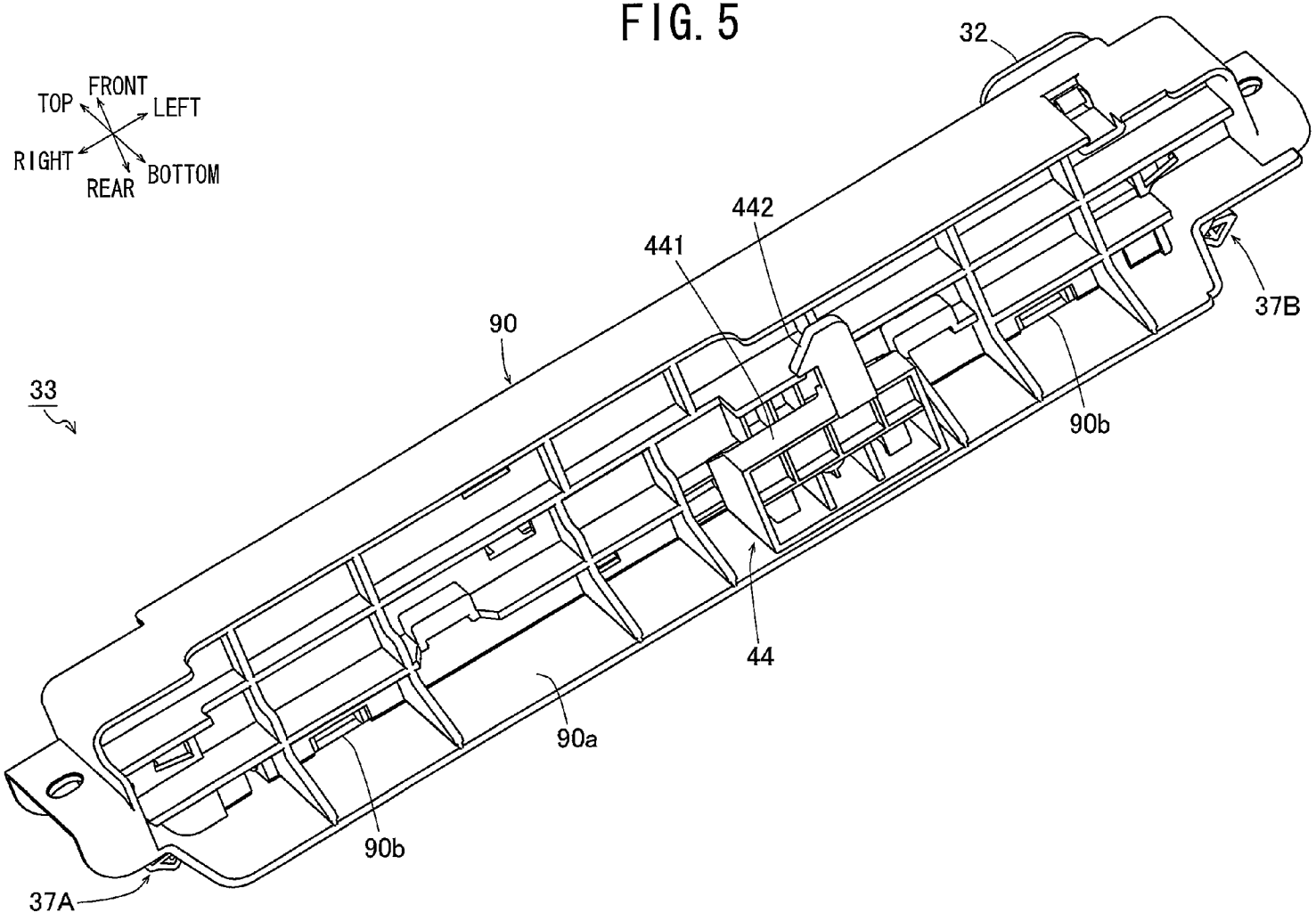
FIG. 5 is a perspective view of the opening/closing mechanism as viewed from a bottom side of the mechanism in the image forming apparatus according to the embodiment.
Figure 6:
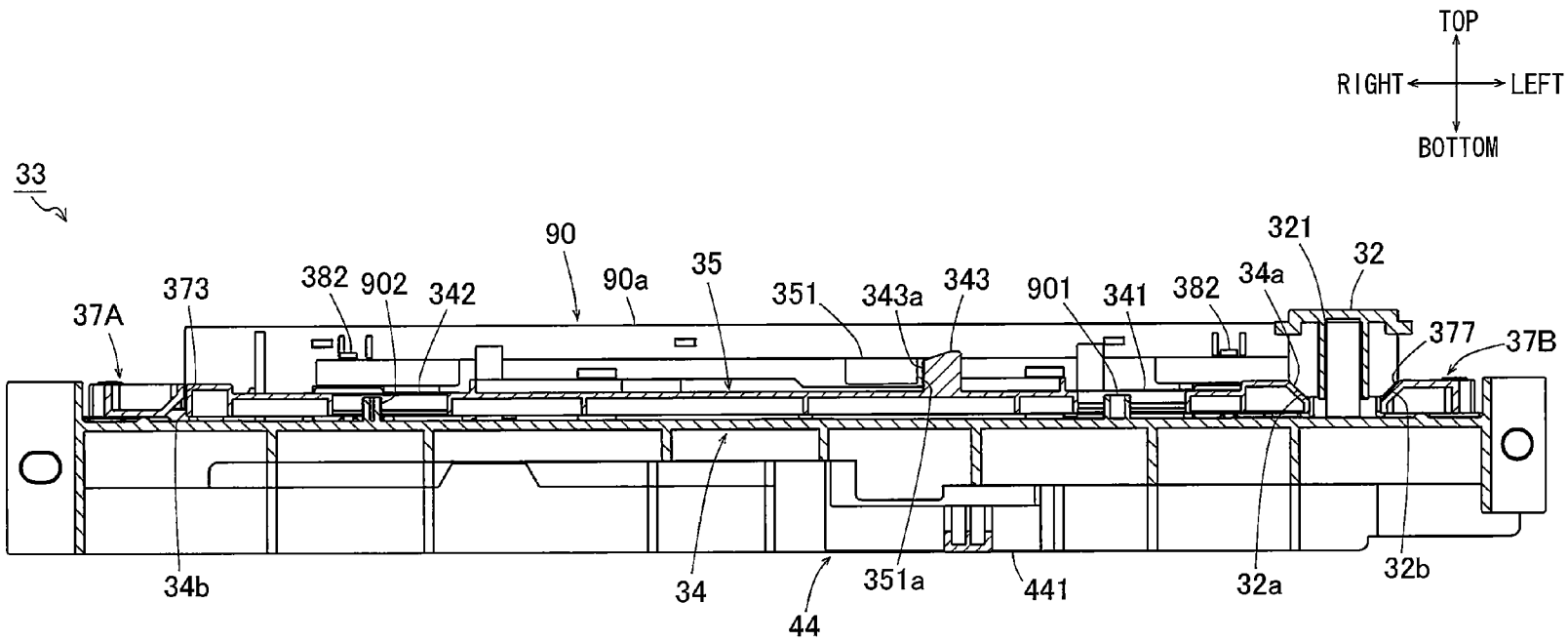
FIG. 6 is a cross-sectional view taken along a line VI-VI of FIG. 4.
Figure 7:
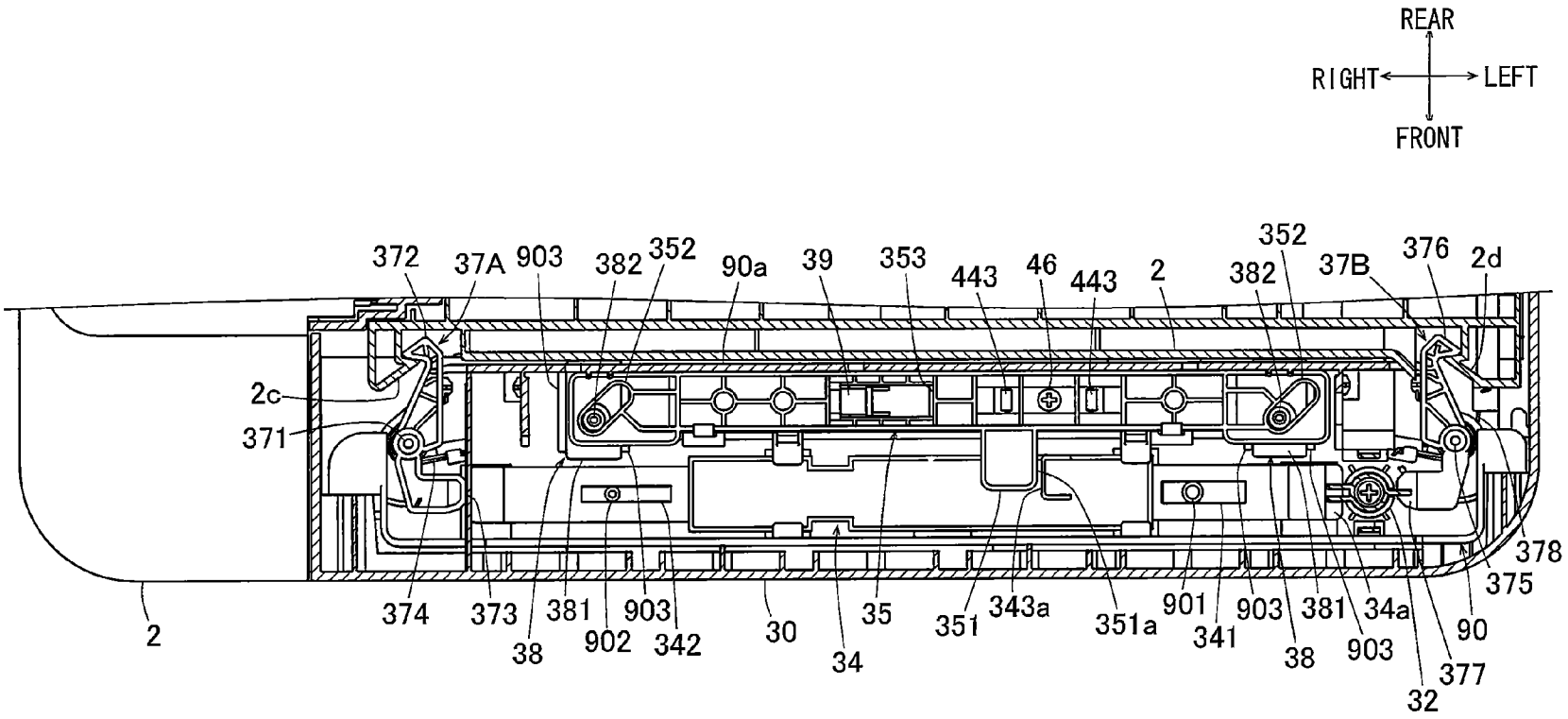
FIG. 7 is a partial cross-sectional view of the opening/closing mechanism at its top side portion thereof in a locking state of the front cover according to the embodiment.
Figure 8:
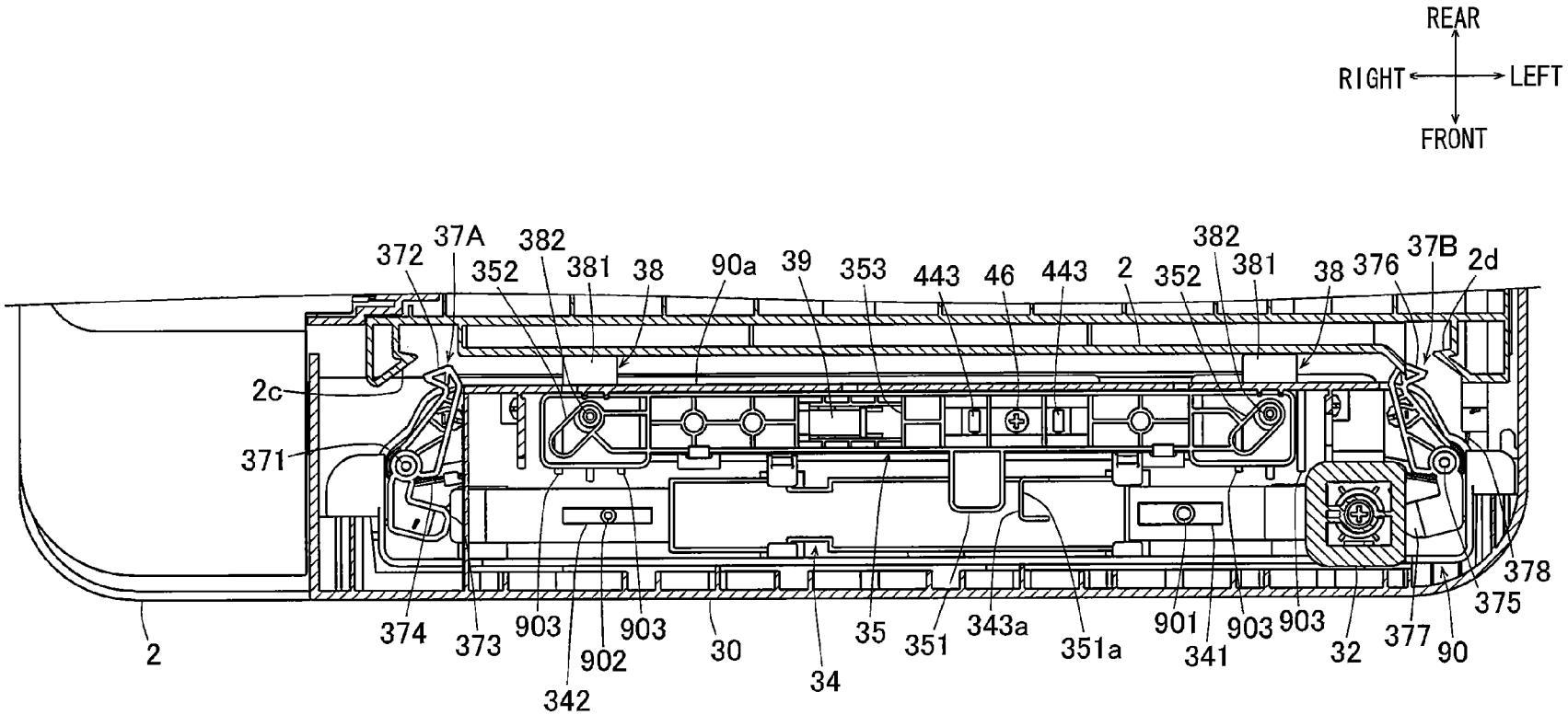
FIG. 8 is a partial cross-sectional view of the opening/closing mechanism at its top side portion thereof when a button is pressed down according to the embodiment.

The front cover opening/closing mechanism 33 for opening and closing the front cover 30 is illustrated in FIGS. 4 through 8. A locking state of the front cover 30 to the housing 2 by the front cover opening/closing mechanism 33 is illustrated in FIG. 7, and a state of the front cover opening/closing mechanism 33 when the button 32 is pressed down is illustrated in FIG. 8.

The front cover opening/closing mechanism 33 includes a link member 36 including a first link member 34 and a second link member 35, a right hook 37A and a left hook 37B, two push members 38, and a urging member 39. These members and the button 32 are accommodated in a casing 90 elongated in leftward/rightward direction.

The first link member 34 is horizontally elongated in leftward/rightward direction, and has a left end positioned below the button 32 and a right end 34*b* in abutment with the right hook 37A. A left end portion of the first link member 34 is formed with a guide slot 341, and a right end portion is formed with a guide slot 342. These guide slots 341 and 342 extend in leftward/rightward direction and penetrate the first link member 34 in vertical direction. Bosses 901 and 902 protrude upward from the casing 90 at positions corresponding to the guide slots 341 and 342, so that the bosses 901 and 902 extend through the guide slots 341 and 342, respectively, and are slidable relative to the guide slots 341 and 342. Thus, the guide slots 341 and 342 are movable in leftward/rightward direction along the bosses 901 and 902. That is, the first link member 34 is slidably movable in leftward/rightward direction relative to the casing 90.

In the present embodiment, the rightward direction which is one of sliding directions of the first link member 34 is parallel to the front cover pivot shaft 31 including the first pivot shaft. As illustrated in FIG. 6, the left end portion of the first link member 34 has a sloped surface 34*a* sloped downward toward the left end. The button 32 has a sloped surface 32*a*. The sloped surface 34*a* is abuttable on the sloped surface 32*a*. When the button 32 is pressed down, the sloped surface 32*a* is moved downward, so that the sloped surface 34*a* is pressed downward by the sloped surface 32*a*. Accordingly, the sloped surface 34*a* is pushed rightward by a component force directing rightward. Thus, the first link member 34 is slidingly moved rightward.

The first link member 34 has an upper central portion in leftward/rightward direction at which a protruding portion 343 protrudes upward. The protruding portion 343 has a right side surface forming a pressure surface 343*a* extending in a direction parallel to frontward/rearward direction. The pressure surface 343*a* can push the second link member 35 in accordance with the rightward sliding movement of the first link member 34.

The right hook 37A is positioned at a right end of the casing 90 and has an inverted S-shape. The right hook 37A includes a pivot shaft portion 371 positioned at a center portion thereof and extending in vertical direction, a hooked portion 372 constituting a rear portion of the right hook 37A, and a pressing portion 373 constituting a front end of the right hook 37A. The right hook 37A is pivotally movable about an axis of the pivot shaft portion 371 and supported to the casing 90. A hooked portion 2*c* (FIG. 7) is provided at the front wall of the housing 2. A torsion coil spring 374 is provided for urging the hooked portion 372 in a direction to engage the hooked portion 2*c*.

The pressing portion 373 is in abutment with the right end portion 34*b* of the first link member 34. When the button 32 is pressed down while the front cover 30 is at the closed position, the first link member 34 is slidingly moved rightward, so that the pressing portion 373 is pressed by the right end portion 34*b*. Because of the pressure application to the pressing portion 373 from the right end portion 34*b*, the right hook 37A is pivotally moved in clockwise direction about the pivot shaft portion 371 in plan view. Thus, the hooked portion 372 is disengaged from the hooked portion 2*c* of the housing 2. Accordingly, locking engagement at the right side of the front cover 30 is released.

When pressing to the button 32 is stopped, the right hook 37A is pivotally moved in counter-clockwise direction because of the biasing force of the torsion coil spring 374, so that the pressing portion 373 presses the right end portion 34*b* of the first link member 34. Thus, the first link member 34 is slidingly moved leftward to restore its original position. In this case, the sloped surface 34*a* of the first link member 34 presses the sloped surface 32*a* of the button 32, so that the button 32 is moved up to restore original position of the button 32. A compression coil spring 321 orienting in vertical direction is provided in the button 32. Thus, the button 32 can be urged toward its original position by the biasing force of the compression coil spring 321.

The left hook 37B is positioned at a left end of the casing 90 and has S-shape which is inverted shape of the right hook 37A. Similar to the right hook 37A, the left hook 37B includes a pivot shaft portion 375, a hooked portion 376, and a pressing portion 377. The left hook 37B is pivotally movable about an axis of the pivot shaft portion 375 and supported to the casing 90. A hooked portion 2*d* (FIG. 7) is provided at the front wall of the housing 2. A torsion coil spring 378 is provided for urging the hooked portion 376 in a direction to engage the hooked portion 2*d*. The pressing portion 377 has a sloped surface bearing symmetrical relationship to the sloped surface 34*a* of the first link member 34. The sloped surface of the pressing portion 377 is abuttable on the sloped surface 32*b* provided at the power end portion of the button 32.

When the button 32 is pressed down, the sloped surface 32*b* is moved downward, so that the pressing portion 377 is pressed downward by the sloped surface 32*b*. Because of the pressure application to the pressing portion 377 from the sloped surface 32*b*, the left hook 37B is pivotally moved in counter-clockwise direction about the axis of the pivot shaft portion 375 in plan view. Thus, the hooked portion 376 is disengaged from the hooked portion 2*d* of the housing 2. Accordingly, locking engagement at the left side of the front cover 30 is released.

When pressing to the button 32 is stopped, the left hook 37B is pivotally moved in clockwise direction because of the biasing force of the torsion coil spring 378, so that the pressing portion 377 presses the sloped surface 32*b* of the button 32. Thus, the button 32 is pressed upward to restore its original position.

The second link member 35 is an elongated member extending in leftward/rightward direction, and is positioned closer to the housing 2 than the first link member 34 to the housing 2. That is, the second link member 35 is positioned rearward of the first link member 34 and juxtaposed with the first link member 34. A pressing portion 351 protrudes frontward from a central front portion of the second link member 35. The pressing portion 351 has a left side surface functioning as a pressing surface 351*a* (FIG. 6) extending in frontward/rearward direction. The pressing surface 351*a* is pressed rightward by the protruding portion 343 of the first link member 34 in accordance with the rightward sliding movement of the first link member 34. Thus, the second link member 35 is slidingly moved rightward.

The second link member 35 has a left end portion and a right end portion each being formed with a guide slot 352. Each guide slot 352 extends diagonally relative to the leftward/rightward direction. More specifically, each guide slot 352 has a right end and a left end, and the right end is positioned frontward of the left end. The push member 38 has bosses 382. Each of the bosses 382 is in sliding engagement with each of the guide slots 352 so as to guide the boss 382 in accordance with the leftward/rightward sliding movement of the second link member 35.

The push member 38 protrudes rearward for pushing the housing 2. This protruding direction is opposite to the opening direction of the front cover 30. The push member 38 is positioned below the guide slot 352 and is mounted on the casing 90. The push member 38 includes a base portion 381 having generally box shape, and the boss 382 provided at the upper surface of the base portion 381. As is apparent from FIGS. 4 and 7, two base portions 381 spaced away from each other in the leftward/rightward direction are provided, and the boss 382 is provided at each of the base portions 381. A guide portion 903 is provided beside each of the base portions 381. That is, each guide portion 903 includes a pair of ribs extending in frontward/rearward direction. One of the ribs is positioned beside and along a right side of the base portion 381, and the other rib is positioned beside and along a left side of the base portion 381. The casing 90 has a rear wall 90*a* formed with openings 90*b*. Each of the openings 90*b* is in confrontation with each rear end surface of each of the base portions 381. Therefore, the push member 38 is slidably movable along the guide portion 903 in frontward/rearward direction, and is protrudable out of the housing 2 through the openings 90*b*.

Each of the bosses 382 is engaged with each of the guide slots 352 of the second link member 35. As illustrated in FIG. 7, the boss 382 is positioned at a front end portion of the guide slot 352 when the front cover 30 is at the closed position. In accordance with the rightward sliding movement of the second link member 35, the guide slot 352 guides the boss 382 rearward. Accordingly, the boss 382 is moved to a rear end portion of the guide slot 352, so that the base portion 381 is slidingly moved rearward to protrude toward the housing 2. In this case, the base portion 381 presses the housing 2 to generate reaction force, so that the front cover 30 is moved to the open position due to the reaction force.

In this way, the sliding movement of the second link member 35 can be converted into protruding movement of the push member 38 with the simple structure using the boss 382 and the guide slot 352. Further, the front cover 30 can be uniformly pressed at two locations spaced away from each other in leftward/rightward direction facilitating opening movement of the front cover 30 in stabilized fashion, because the push member 38 is positioned at each of the leftward and rightward end portions of the second link member 35.

The urging member 39 is a compression coil spring adapted to urge the second link member 35 rightward. The second link member 35 has a central portion in leftward/rightward direction formed with an opening 353. The urging member 39 has a right end supported to the opening 353, and a left end supported to a protruding portion of the casing 90.

The urging member 39 is at a compressed state when the front cover 30 is at the closed position. Accordingly, when the button 32 is pressed down when the front cover 30 is at the closed position, the second link member 35 is urged rightward because of the resiliency (restoration force) of the urging member 39 to protrude the push member 38. In this way, urging force of the urging member 39 is added in addition to the pressing force of the push member 38, so that the front cover 30 can be easily opened with a small operating force to be applied to the button 32.

The push member 38 does not return into the casing 90 because of the urging force of the urging member 39 even after stopping pressing operation against the button 32. When the front cover 30 is closed by a user, the push member 38 is pressed by the housing 2 and is moved frontward into the casing 90. Thus, the boss 382 presses the guide slot 352 to slidingly move the second link member 35 leftward.

With such a structure of the front cover opening/closing mechanism 33, the front cover 30 can be opened with certainly by the push member 38 to which pressing force of the button 32 is transmitted. Further, the right hook 37A and the push member 38 are pressed by the sliding movement of the first link member 34 and the second link member 35. Therefore, a force for pressing the button 32 is smaller and a vertical size can be smaller than those required in a conventional pivotally moving mechanism.

[Operation in Mechanism for Opening/Closing Front Cover]

Opening operation achieved by the front cover opening/closing mechanism 33 will be described with reference to FIGS. 7 and 8. As illustrated in FIG. 7, the right hook 37A and the left hook 37B are engaged with the hooked portion 2*c* and the hooked portion 2*d* of the housing 2, respectively, when the front cover 30 is at the closed position. Thus, the front cover 30 is locked to the housing 2.

When the button 32 is pressed down in the closed state of the front cover 30, the sloped surface 32*a* of the button 32 is moved downward to press the sloped surface 34*a* of the first link member 34 downward. As a result, the sloped surface 34*a* is pressed rightward because of the rightward component force, so that the first link member 34 is slidingly moved rightward.

By the rightward sliding movement of the first link member 34, the right end portion 34*b* of the first link member 34 presses the pressing portion 373 of the right hook 37A, so that the right hook 37A is pivotally moved in clockwise direction about the axis of the pivot shaft portion 371 in plan view. Accordingly, the hooked portion 372 is disengaged from the hooked portion 2*c* of the housing 2 to release locking at the right side of the front cover 30 (FIG. 8).

Further, when the button 32 is pressed down, the sloped surface 32*b* of the button 32 is moved downward to press the pressing portion 377 of the left hook 37B downward. As a result, the pressing portion 377 is pressed leftward because of the leftward component force, so that the left hook 37B is pivotally moved in counterclockwise direction about the axis of the pivot shaft portion 375 in plan view. Thus, the hooked portion 376 is disengaged from the hooked portion 2*d* of the housing 2 to release locking at the left side of the front cover 30 (FIG. 8). Such releasing operation at the right side and left side of the front cover 30 is performed approximately simultaneously.

Further, in accordance with the rightward sliding movement of the first link member 34, the protruding portion 343 of the first link member 34 urges the pressing portion 351 of the second link member 35 rightward. Accordingly, the second link member 35 is slidingly moved rightward. In this case, the second link member 35 is urged rightward because of the restoration force of the urging member 39. Therefore, the biasing force of the urging member 39 assists movement of the push member 38.

By the rightward sliding movement of the second link member 35, the guide slot 352 guides the boss 382 of the push member 38 to move frontward. As a result, the boss 382 is moved to the rear end of the guide slot 352, so that the base portion 381 of the push member 38 is slidingly moved rearward. Thus, the base portion 381 protrudes toward the housing 2. By the protruding movement of the base portion 381, the rear end face of the base portion 381 presses against the front surface of the housing 2, so that the front cover 30 is moved in the opening direction because of the reaction force from the housing 2. Thus, the urging member 39 is slightly moved in the opening direction (FIG. 8).

The releasing operation at the right hook 37A and the left hook 37B and the opening operation of the push member 38 for moving the front cover 30 in the opening direction is performed simultaneously. Alternatively, the releasing operation is performed prior to the opening operation. Consequently, smooth operation can be performed, because pressing against the housing 2 by the push member 38 with the locking state of the front cover 30 does not occur.

In this way, when the button 32 is pressed down while the front cover 30 is at the closed position, locking engagement at the right hook 37A and the torsion coil spring 378B is released, and the push member 38 presses against the front surface of the sheet supply mechanism 20 to move the front cover 30 in the opening direction. In such sequential operation, power transmission between components is exclusively achieved by pressing force. Thus, the front cover 30 can be opened stably only by pressing the button 32.

[Structure of MP Tray Lock Mechanism]

Figure 9:
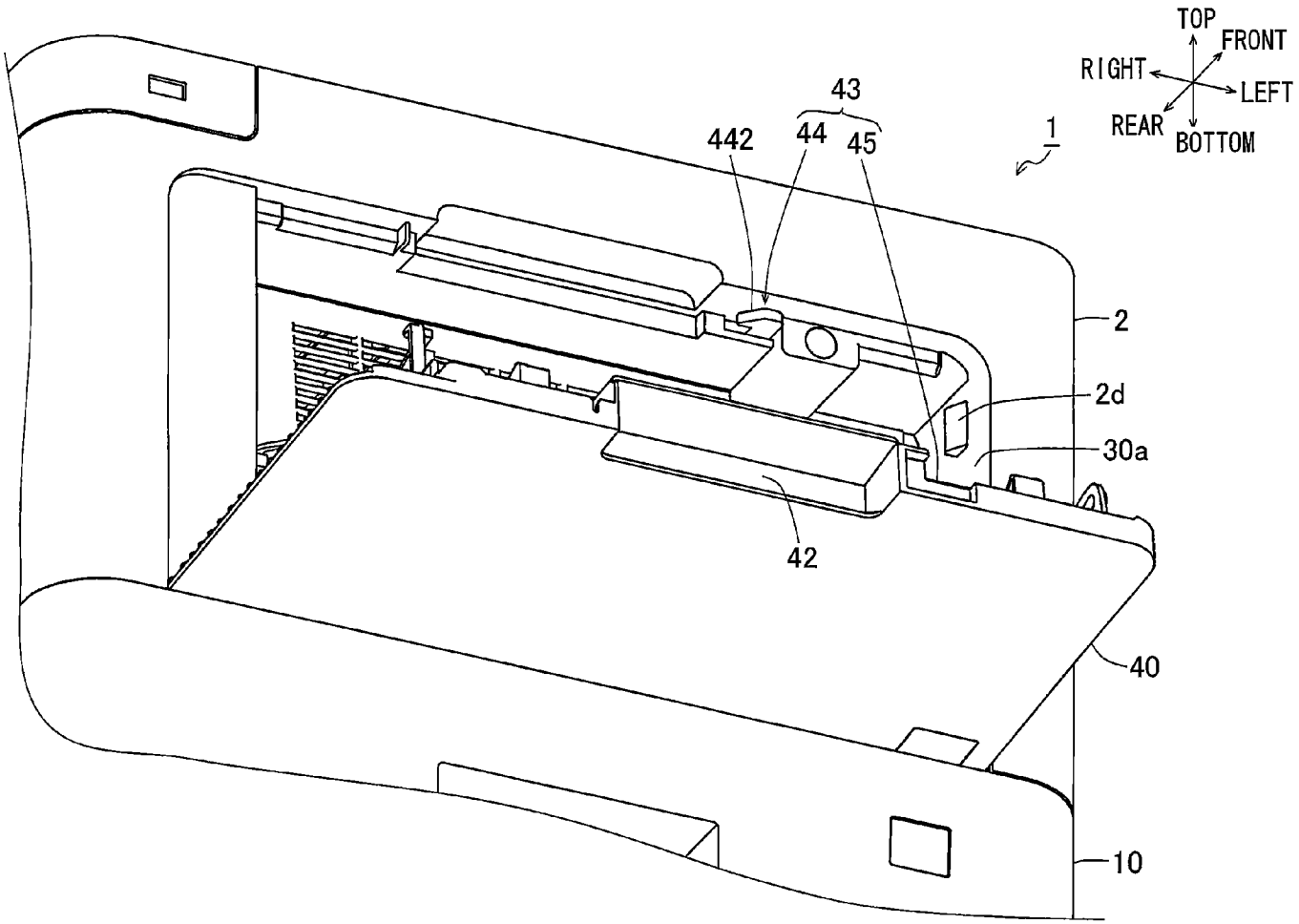
FIG. 9 is a partial perspective view of the image forming apparatus according to the embodiment.
Figure 10:
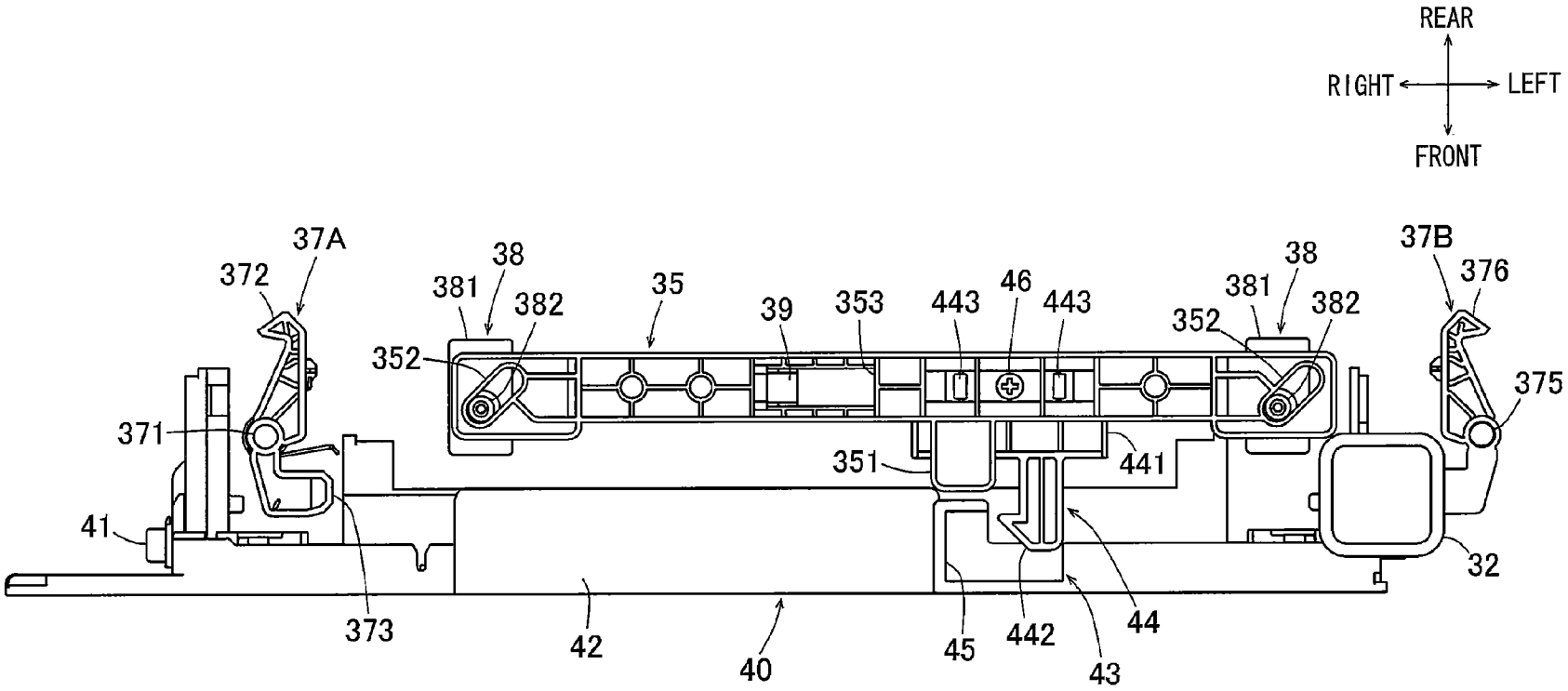
FIG. 10 is a view for description of a multi-purpose tray lock mechanism in the closed state of the front cover in the image forming apparatus according to the embodiment.
Figure 11:
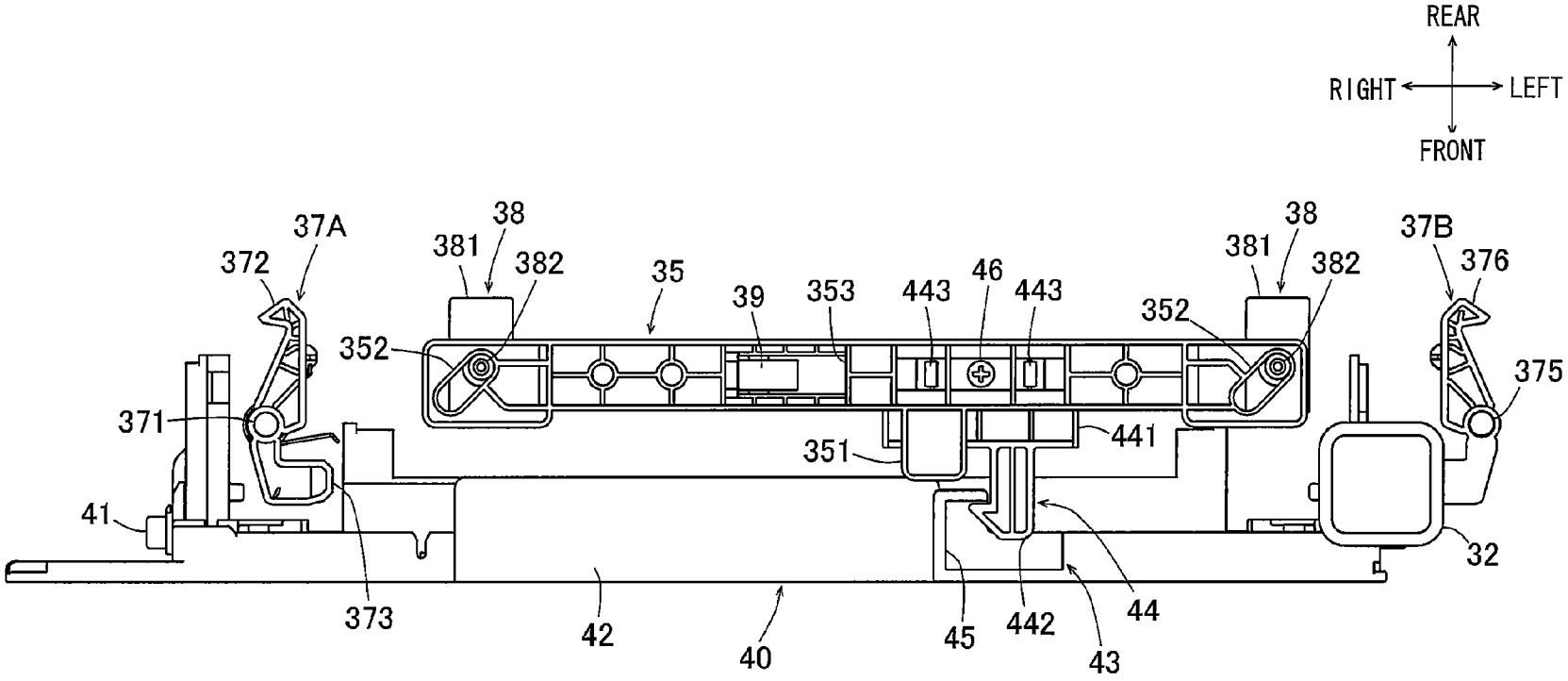
FIG. 11 is a view for description of the multi-purpose tray lock mechanism in the open state of the front cover in the image forming apparatus according to the embodiment.

The MP tray lock mechanism 43 will next be described with reference to FIGS. 9 through 11. FIG. 9 is a partial perspective view of the image forming apparatus 1 while the MP tray 40 is opened. FIG. 10 is a view for description of the MP tray lock mechanism 43 in the closed state of the front cover 30. FIG. 11 is a view for description of the MP tray lock mechanism in the open state of the front cove 30. In FIGS. 10 and 11, several parts and components are omitted for simplicity and for better understanding. The tray lock mechanism 43 is constituted by a multi-purpose tray hook (MP tray hook) 44 provided at the second link member 35, and a groove 45 formed in the MP tray 40.

The MP tray hook 44 is engageable with the groove 45 by the rightward sliding movement of the second link member 35 during opening movement of the MP tray 40. As illustrated in FIG. 5, the MP tray 40 is positioned at an outer bottom surface of the casing 90. The MP tray hook 44 includes a base portion 441 generally box shaped, the hand grip 42 provided at the front side of the base portion 441, and a pair of hooked portions 443 provided at an upper surface of the base portion 441. The hooked portions 443 are fitted with a hole formed in the second link member 35, and are fixed to the second link member 35 by a screw 46 from above the upper surface of the second link member 35.

The groove 45 is generally L-shaped, and is positioned leftward of the hand grip 42. The groove 45 has a notched portion in confrontation with the hooked portion 442 of the MP tray hook 44, so as to allow the hooked portion 442 to be engaged with the groove 45. That is, during opening movement of the front cover 30 while the MP tray 40 is at the closed position, the MP tray hook 44 is engaged with the groove 45. Such a simple construction using the MP tray hook 44 and the groove 45 can lock the MP tray 40 to the front cover 30.

[Operation in MP Tray Lock Mechanism]

Operation in the MP tray lock mechanism 43 will be described with reference to FIGS. 10 and 11. In a state where the front cover 30 is at the closed position, the MP tray lock mechanism 43 locking engagement by the MP tray lock mechanism 43 is released as illustrated in FIG. 10, so that the MP tray 40 can be freely opened and closed.

When the button 32 is pressed down in this released state, the MP tray hook 44 is slidingly moved rightward in accordance with the rightward sliding movement of the second link member 35, so that the hooked portion 442 of the MP tray hook 44 is engaged with the groove 45 (FIG. 11). Thus, the MP tray 40 is locked to the front cover 30. The MP tray 40 is not freely opened because of the locking engagement to the front cover 30 even if impacting force is applied to the MP tray 40 or front cover 30 during opening movement of the front cover 30 by the user after the slight opening movement of the front cover 30.

Then, in the closing stroke of the front cover 30, the push member 38 is pressed by the front surface of the housing 2 and is slidingly moved frontward. Thus, the second link member 35 is slidingly moved leftward. Accordingly, the hooked portion 442 of the MP tray hook 44 that has been engaged with the groove 45 is slidingly moved rightward to disengage from the groove 45 restoring the state shown in FIG. 10. Consequently, locking state of the tray lock mechanism 43 is released to allow the MP tray 40 to be freely opened and closed.

Modifications

The first link member 34 and the second link member 35 can be integral with each other. For example, the protruding portion 343 of the first link member 34 can be integral with the pressing portion 351 of the second link member 35. This structure can provide function and effect similar to those of the above-described front cover opening/closing mechanism 33.

The urging member 39 is provided in the above-described embodiment. However, the urging member 39 is not necessarily provided. The front cover 30 can be moved in the opening direction with a small force generated by depression of the button 32 even by the omission of the urging member 39.

Two push members 38 are provided in the above-described embodiment. However, a single push member or not less than three push members are available. In case of the single push member, the push member should be elongated in leftward/rightward direction to increase contacting area relative to the front surface of the housing 2, thereby stabilizing opening movement of the front cover 30. In case of the three or more push members, the front surface of the housing 2 can be uniformly pressed at a plurality of locations, thereby stabilizing the opening movement of the front cover 30.

In the above-described embodiment, the button 32 is positioned at the upper surface of the front cover 30. However, the position of the button 32 is not limited to the upper surface of the front cover 30. The button 32 can be positioned at either one of a front surface, a right surface or a left surface of the front cover 30.

In the above-described embodiment, the right hook 37A and the left hook 37B are provided for locking the front cover 30 to the housing 2. However, only one of the right hook 37A and the left hook 37B can be provided. Alternatively, not less than three hooks can be provided.

In the above-described embodiment, the right hook 37A, the left hook 37B, and the MP tray hook 44 are employed as locking members. However, a magnet and a pin are also available as long as these can perform locking engagement.

Advantageous Effects of Embodiments

An image forming apparatus 1 according to the above-described embodiments includes: a housing 2; first opening 2*a*; a front cover 30; a button 32; a link member 36; a right hook 37A; and a push member 38. The housing 2 is generally box shaped and has a side surface and a bottom surface. The first opening 2*a* is open at the side surface. The front cover 30 has a first pivot shaft positioned adjacent to a lower end of the first opening 2*a* and extending in a direction parallel to the bottom surface. The front cover 30 is pivotally movable about an axis of the first pivot shaft between a closed position closing the first opening 2*a* and an open position opening the first opening 2*a*. The button 32 is provided at the front cover 30 and is configured to be depressed. The link member 36 is provided at the front cover 30 and is configured to be slidingly moved in a prescribed direction parallel to the first pivot shaft in response to the depression of the button 32. The right hook 37A is provided at the front cover 30 and is configured to provide locking engagement between the front cover 30 and the housing 2. The right hook 37A as a first locking member is pressed by the link member 36 in accordance with the sliding movement of the link member 37 in the prescribed direction to release the locking engagement. The push member 38 is provided at the front cover 30 and is configured to move in a direction opposite to an opening direction of the front cover 30 to be pressed against the housing 2 when the front cover 30 is at the closed position in accordance with the sliding movement of the link member 36 in the prescribed direction. The depression of the button 32 causes both unlocking and movement of the front cover 30 in the opening direction when the front cover 30 is at the closed position.

With this configuration, the front cover 30 can be opened with certainly by the push member 38 to which pressing force of the button 32 is transmitted between components. Further, the right hook 37A and the push member 38 are pressed by the sliding movement of the link member 36 including the first link member 34 and the second link member 35. Therefore, a force for pressing the button 32 is smaller and a vertical size can be smaller than those required in a conventional pivotally moving mechanism.

Preferably, the image forming apparatus 1 according to the above-described embodiments further includes an urging member 39. The urging member 39 urges the link member 36 in the prescribed direction.

With this configuration, urging force of the urging member 39 is added in addition to the pressing force of the push member 38, so that the front cover 30 can be easily opened with a small operation force to be applied to the button 32.

Preferably, the image forming apparatus 1 according to the above-described embodiments includes a plurality of push members 38 arrayed in the prescribed direction.

With this configuration, the front cover 30 can be uniformly pressed at a plurality of locations spaced away from on another facilitating opening movement of the front cover 30 in stabilized fashion, because a plurality of push members 38 is positioned.

Preferably, in the image forming apparatus 1 according to the above-described embodiments, the link member 36 has end portions in the prescribed direction. The push member 38 is provided at each end portion.

With this configuration, the front cover 30 can be uniformly pressed facilitating opening movement of the front cover 30 in stabilized fashion only by providing few push members 38.

Preferably, in the image forming apparatus 1 according to the above-described embodiments, the push member 38 has an upper surface provided with a boss 382. The link member 36 is formed with a guide slot 352 extending in a direction crossing the prescribed direction. The boss 382 is engaged with the guide slot 352 and is movable relative to the guide slot 352. The sliding movement of the link member 36 in the prescribed direction permits the boss 382 to be guidedly moved in the guide slot 352 to move the push member 28 toward the housing 2.

With this configuration, the sliding movement of the second link member 35 included in the link member 36 can be converted into protruding movement of the push member 38 with the simple structure using the boss 382 and the guide slot 352.

Preferably, in the image forming apparatus 1 according to the above-described embodiments, the button 32 is provided at an upper surface of the front cover 30.

With this configuration, the button 32 is easily visible and easily pressed down.

Preferably, in the image forming apparatus 1 according to the above-described embodiments, the link member 36 includes: a first link member 34; and a second link member 35. The first link member 34 is slidingly moved in the prescribed direction by the depression of the button 32. The second link member 35 is positioned beside the first link member 34 and between the housing 2 and the first link member 34. The second link member 35 has a pressed portion 351 to which a pressure is applied from the first link member 34 in accordance with the sliding movement of the first link member 34 in the prescribed direction. The second link member 35 is slidingly moved in the prescribed direction by the pressure application. The front cover 30 is formed with a second opening 30*a*. The image forming apparatus 1 further includes: an MP tray 40; and an MP tray hook 44. The MP tray 40 has a second pivot shaft positioned adjacent to a lower end of the second opening 30*a* and extending in a direction parallel to the first pivot shaft. The MP tray 40 is pivotally movable about an axis of the second pivot shaft between a closed position closing the second opening 30*a* and an open position opening the second opening 30*a*. The MP tray hook 44 as a second locking member is provided at the second link member 35 and is configured to lockingly engaged with the MP tray 40 by the sliding movement of the second link member 35 in the prescribed direction.

With this configuration, the MP tray 40 is locked by the MP tray hook 44 during opening movement of the front cover 30. Therefore, the MP tray 40 is not freely opened even if impacting force is applied to the MP tray 40 during opening movement of the front cover 30 after the slight opening movement of the front cover 30.

Preferably, in the image forming apparatus 1 according to the above-described embodiments, the MP tray 40 is formed with a groove 45. The MP tray hook 44 has a hook shape configured to be engaged with the groove 45.

With this configuration, such a simple construction using the MP tray hook 44 and the groove 45 can lock the MP tray 40.

While the description has been made in detail with reference to specific embodiments, it would be apparent to those skilled in the art that various changes and modifications may be made thereto.

What is claimed is:

1. An image forming apparatus comprising:

a housing having a side surface, the side surface having a first opening;

a cover having a first pivot shaft positioned adjacent to a lower end of the first opening, the cover being pivotally movable about an axis of the first pivot shaft between a closed position closing the first opening and an open position opening the first opening;

a button provided at the cover and configured to be depressed;

a link member provided at the cover and configured to be slidingly moved in a prescribed direction parallel to the first pivot shaft in response to the depression of the button;

a first locking member provided at the cover and configured to provide locking engagement between the cover and the housing, the first locking member being pressed by the link member in accordance with the sliding movement of the link member in the prescribed direction to release the locking engagement; and a push member provided at the cover and configured to move in a direction opposite to an opening direction of the cover to be pressed against the housing when the cover is at the closed position in accordance with the sliding movement of the link member in the prescribed direction, the depression of the button causing both unlocking and movement of the cover in the opening direction when the cover is at the closed position.

2. The image forming apparatus according to claim 1, further comprising an urging member urging the link member in the prescribed direction.

3. The image forming apparatus according to claim 1, wherein the push member comprises a plurality of push members arrayed in the prescribed direction.

4. The image forming apparatus according to claim 3, wherein the link member has end portions in the prescribed direction, the push member is provided at each end portion.

5. The image forming apparatus according to claim 1, wherein the push member has an upper surface provided with a boss; and wherein the link member is formed with a guide slot extending in a direction crossing the prescribed direction, the boss being engaged with the guide slot and movable relative to the guide slot, the sliding movement of the link member in the prescribed direction permitting the boss to be guidedly moved in the guide slot to move the push member toward the housing.

6. The image forming apparatus according to claim 1, wherein the button is provided at an upper surface of the cover.

7. The image forming apparatus according to claim 1, wherein the link member comprises:

a first link member slidingly moved in the prescribed direction by the depression of the button; and a second link member positioned beside the first link member and between the housing and the first link member, the second link member having a pressed portion to which a pressure is applied from the first link member in accordance with the sliding movement of the first link member in the prescribed direction, the second link member being slidingly moved in the prescribed direction by the pressure application;

wherein the cover is formed with a second opening; and wherein the image forming apparatus further comprises:

a tray having a second pivot shaft positioned adjacent to a lower end of the second opening, the tray being pivotally movable about an axis of the second pivot shaft between a closed position closing the second opening and an open position opening the second opening; and a second locking member provided at the second link member and configured to lockingly engaged with the tray by the sliding movement of the second link member in the prescribed direction.

8. The image forming apparatus according to claim 7, wherein the tray is formed with a groove, the second locking member having a hook shape configured to be engaged with the groove.

* * * * *